US007678037B2

(12) United States Patent
Campbell

(10) Patent No.: US 7,678,037 B2
(45) Date of Patent: Mar. 16, 2010

(54) PROCESS FOR ASSEMBLING A BAG

(76) Inventor: Mark Campbell, 4370 St. Johns Side Road, RR 3, Newmarket, Ontario (CA) L3Y 4W1

( * ) Notice: Subject to any disclaimer, the term of this patent is extended or adjusted under 35 U.S.C. 154(b) by 445 days.

(21) Appl. No.: 11/637,871

(22) Filed: Dec. 13, 2006

(65) Prior Publication Data

US 2007/0161482 A1 Jul. 12, 2007

(30) Foreign Application Priority Data

Dec. 15, 2005 (CA) ..... 2530339
Oct. 13, 2006 (CA) ..... 2563857

(51) Int. Cl.
*B31B 1/62* (2006.01)

(52) U.S. Cl. ..... 493/150; 493/68; 493/70; 493/79

(58) Field of Classification Search ..... 493/150, 493/131, 68, 70, 79, 93, 151, 219, 94, 95
See application file for complete search history.

(56) References Cited

U.S. PATENT DOCUMENTS 2,113,927 A * 4/1938 Alfred ..... 229/246
3,306,521 A * 2/1967 Giacovas ..... 229/136
3,325,084 A * 6/1967 Ausnit ..... 229/77
3,524,581 A * 8/1970 Buttery ..... 229/226
3,541,930 A * 11/1970 Goodrich ..... 493/126
4,114,777 A * 9/1978 Frohling et al. ..... 229/160.1
4,294,642 A * 10/1981 Focke et al. ..... 156/250
4,490,129 A * 12/1984 Oakley ..... 493/8
4,565,315 A * 1/1986 Wagner et al. ..... 229/122
4,750,609 A * 6/1988 Felis ..... 206/1.7
5,092,516 A * 3/1992 Kastanek ..... 229/226
5,462,223 A * 10/1995 Focke et al. ..... 229/160.1
5,656,084 A * 8/1997 Focke et al. ..... 118/316
5,906,087 A * 5/1999 Boldrini ..... 53/462
6,080,096 A * 6/2000 Becker et al. ..... 493/311
6,190,485 B1 * 2/2001 Cahill et al. ..... 156/195
6,409,646 B1 * 6/2002 Focke et al. ..... 493/7

* cited by examiner

*Primary Examiner*—Sameh H. Tawfik
(74) *Attorney, Agent, or Firm*—Fasken Martineau DuMoulin LLP

(57) ABSTRACT

The invention provides a method of making a bag from a foldable pattern, comprising: a) inserting the foldable pattern into an assembly machine; b) placing a series of glue spots on designated surfaces of the pattern; c) folding the foldable pattern, in a sequence such that the resulting product is a finished bag with a glued bottom; and d) exiting the finished bag from the assembly machine.

13 Claims, 9 Drawing Sheets

PROCESS FOR ASSEMBLING A BAG

FIELD OF THE INVENTION

The present invention relates to the field of assembling bags made of paper and similar materials. In particular, it relates to a new method of assembling bags from foldable patterns via a machine-driven process.

BACKGROUND OF THE INVENTION

In recent years, as consumer awareness of environmentalism has increased, the use of paper bags has increased significantly, particularly for use as shopping bags (replacing plastic) or as "gift bags" (replacing wrapping paper). The bags are readily re-usable, being generally more durable than plastic, and recyclable. Furthermore, the exterior of the bag can be readily imprinted with a design, either decorative (for a gift bag) or with a company name or logo (for shopping bags).

Paper bags, in particular those used as shopping bags and gift bags, use glued bottoms to increase the amount of weight that can be supported. The typical fold pattern used has proven difficult to automate and to date has been limited at best to lightweight paper stock and small size products, such as sugar bags and similar items. Gift and shopping bags require more elaborate patterns and are not well-suited to mass production. Therefore, the majority of paper bags used as gift or shopping bags are made by hand labor to create a bag from heavy paper stock and sufficient size and strength to hold heavier products.

There is clearly a need for a method of assembling paper bags without the need to incorporate hand labor into the assembly process. Furthermore, any such process should be capable of producing a bag of size and strength comparable to the existing bags produced via hand labor.

SUMMARY OF THE INVENTION

According to an aspect of the invention, there is provided a method of making a bag from a foldable pattern, comprising: a) inserting the foldable pattern into an assembly machine; b) placing a series of glue spots on designated surfaces of the pattern; c) folding the foldable pattern, in a sequence such that the resulting product is a finished bag with a glued bottom; and d) exiting the finished bag from the assembly machine. Preferably, an additional step is included of inserting a reinforcing element into the pattern in a position such that the reinforcing element acts to reinforce the bottom of the bag;

Preferably, the folding step may include folding over a perimeter edge of the pattern to produce a reinforced top for the bag. Optionally, this reinforced top provides an opening to insert a handle.

Also preferably, the handle is made of string, and is inserted as part of the folding step.

Other and further advantages and features of the invention will be apparent to those skilled in the art from the following detailed description thereof, taken in conjunction with the accompanying drawings.

BRIEF DESCRIPTION OF THE DRAWINGS

The invention will now be described in more detail, by way of example only, with reference to the accompanying drawings, in which like numbers refer to like elements, wherein.

DETAILED DESCRIPTION OF THE PREFERRED EMBODIMENTS

Figure 1:
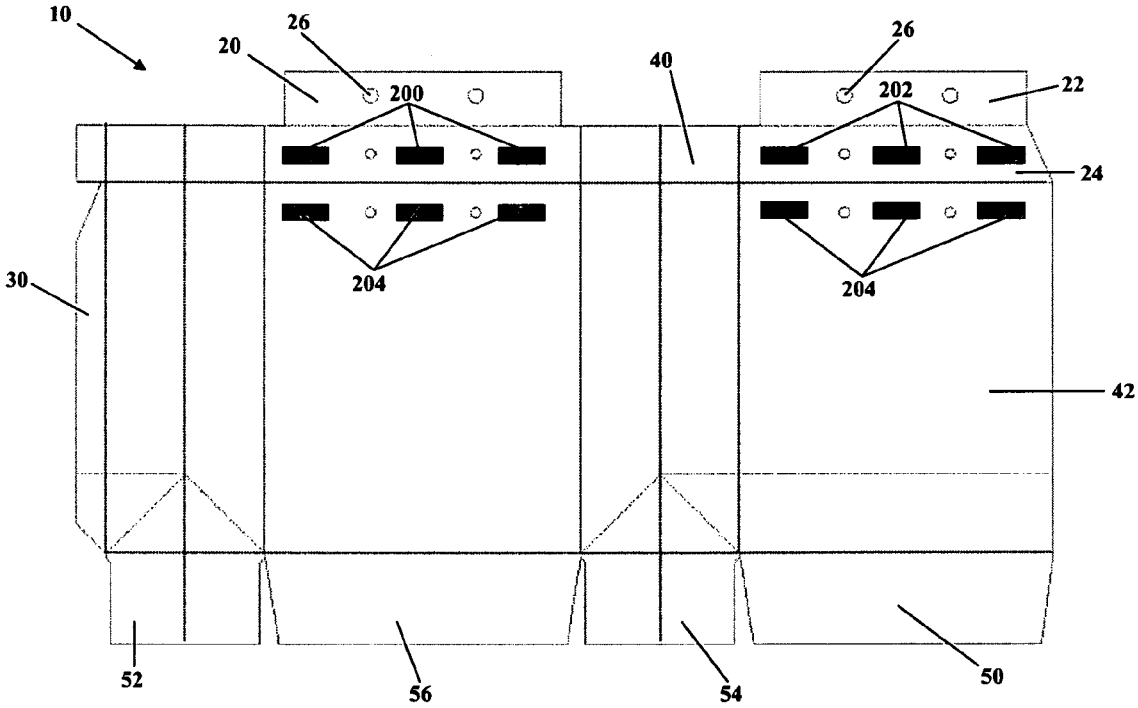
FIG. 1 is a top view of a foldable bag pattern for use in the present invention.

Referring to FIG. 1, a foldable pattern for a paper bag is indicated by reference numeral 10. Crease lines for folding the pattern into a bag are shown as dashed lines in FIG. 1 and all other Figures. Located at the various foldover locations for assembly of the bag are glue spots as exemplified by 200, 202 and 204. Almost any type of glue that securely bonds the bag material to itself is suitable, however, it is preferable that a hot melt glue or an equivalent is used. Additional glue spots are shown in other Figures. While the glue spots shown are only on a single surface where two pieces of the pattern 10 are joined, the spots may be applied to both surfaces that are meant to contact each other, depending on the type of glue used. Also, the total number of glue spots may be adjusted to reflect the dimensions and materials used for the container. Similarly, the size and shape of glue spots can be varied to determine the optimal values for a container of a specific size and material.

When the pattern 10 is folded into a bag, the glue spots secure the surfaces of the pattern 10 together, at all the seams and the bottom. The result is that the finished bag has a glued bottom and seams, providing structural strength. This strength can be increased by inserting a piece of heavyweight paper or cardboard as a reinforcing element into the bottom as part of the folding and gluing process.

Another method of reinforcing the bag is along the top. By folding over the perimeter edges 20, 22, 24 of the pattern and gluing them to each other, a thicker, stronger top edge is created for the finished bag. Preferably, this top edge should include holes (26 in FIG. 1) that permit a handle to be inserted. Such handles are often made of string, and can be inserted and glued to the bag as part of the assembly process. Alternatively, a handle-shaped pattern may be cut out of the bag, resulting in an integral handle without require further elements to be added.

To assemble the bag, the pattern 10 is placed into a machine, which applies the glue spots and folds the pattern 10 in the proper sequence to assemble a finished bag. According to the pattern shown, the folding sequence runs top, sides, and bottom. If a handle is to be inserted, it is preferably done either as part of the top edge folding and gluing sequence, or as a separate process after the bag is completed, to ensure that the handle is fully integrated into the bag. Similarly, the reinforcing cardboard (or similar piece) is inserted and glued to the bottom as part of the bottom folding and gluing sequence.

Figure 2:
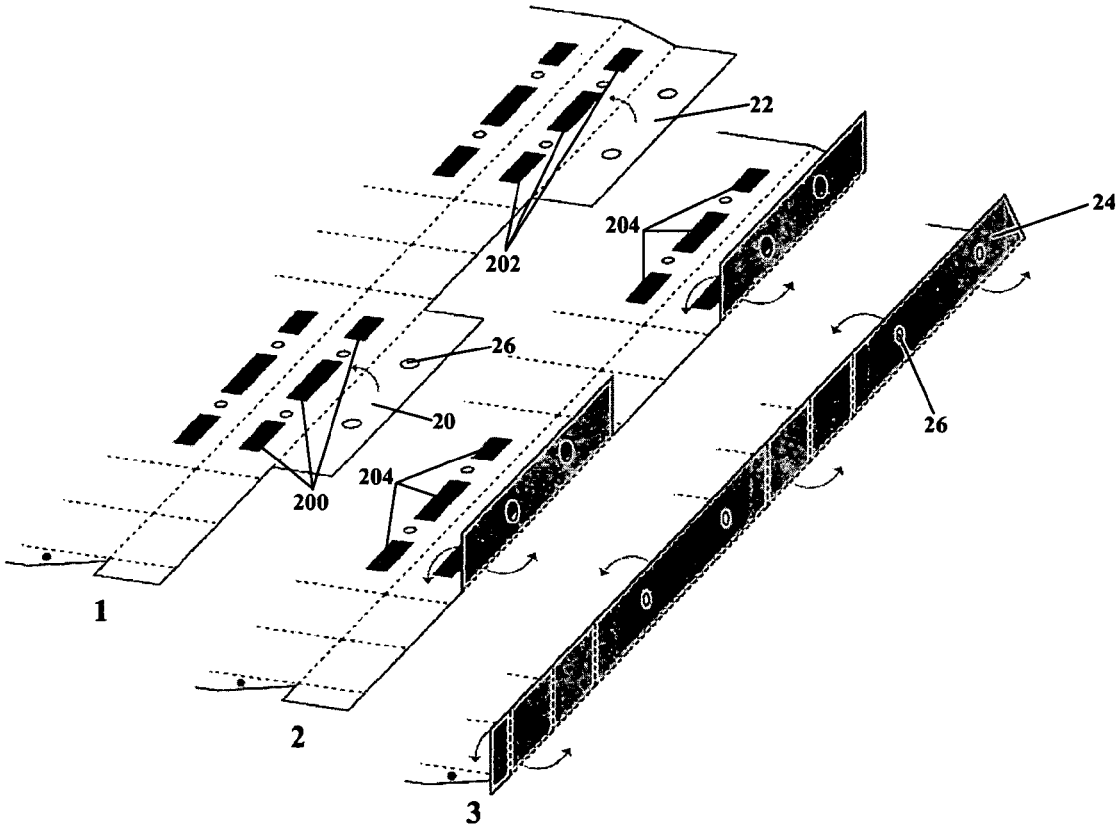
FIG. 2 is a close-up view of the first three steps of the folding process.

The stages of the folding process are shown in greater detail starting with FIG. 2. Tabs 20 and 22 are folded over in the direction of the arrows and secured by glue spots 200 and 202. Next, the entire top edge 24 is folded over and secured by glue spots 204 to create the reinforced top edge of the bag. Holes 26 provide a location to attach a handle, if one is desired. Alternatively, the pattern 10 may include a cut-out handle location. Other known handles for bags can be similarly used.

Figure 3:
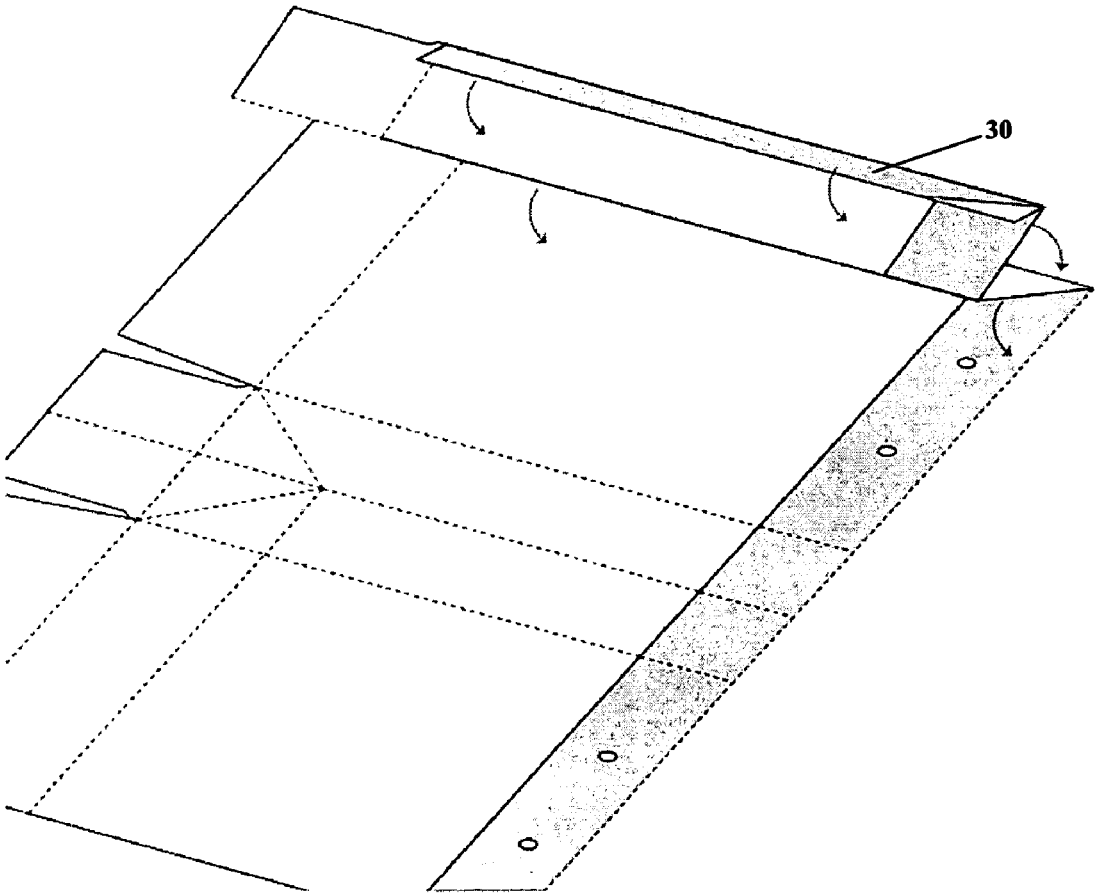
FIG. 3 is a close-up view of the side z-fold step of the folding process.
Figure 4:
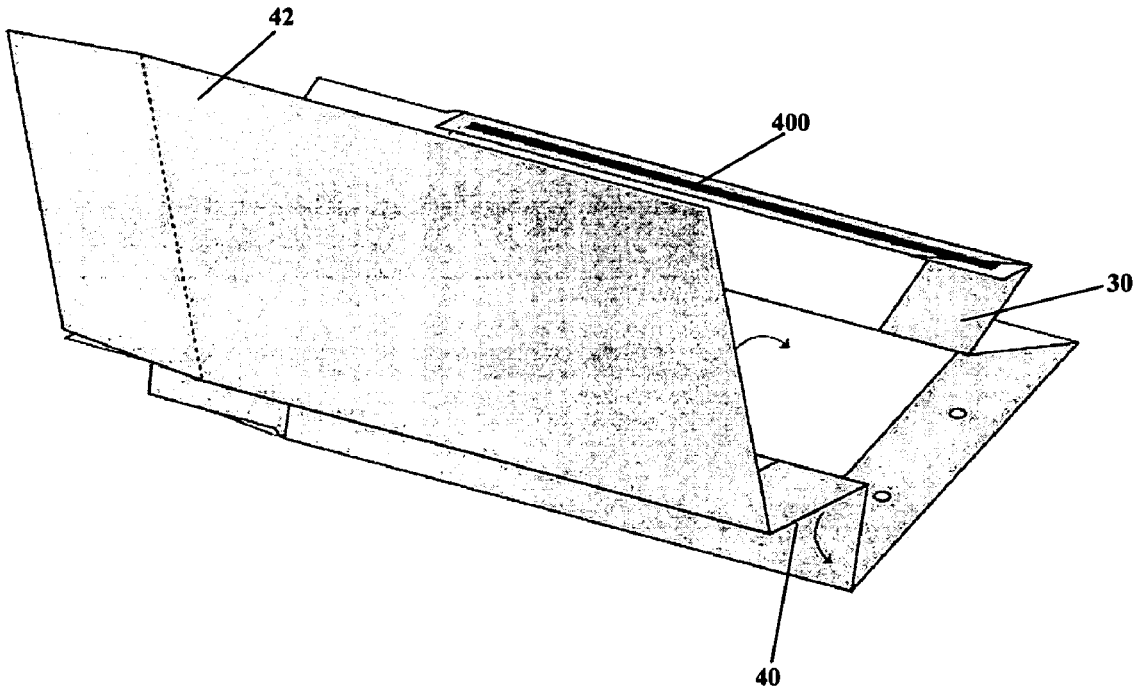
FIG. 4 is a side view of the second side z-fold step of the folding process.

As shown in FIG. 3, the next step is a z-fold of the side 30. The z-fold enables the side of the bag to be collapsed flat for assembly and shipping, and then be expanded upon use to create the bag. The folds proceed in the direction shown by the arrows. Once the z-fold is complete, the opposing side 40 is similarly z-folded and the front plane 42 is folded over and glued to the first side 30 by glue spot 400, completing the body of the bag, as shown in FIG. 4.

Figure 5:
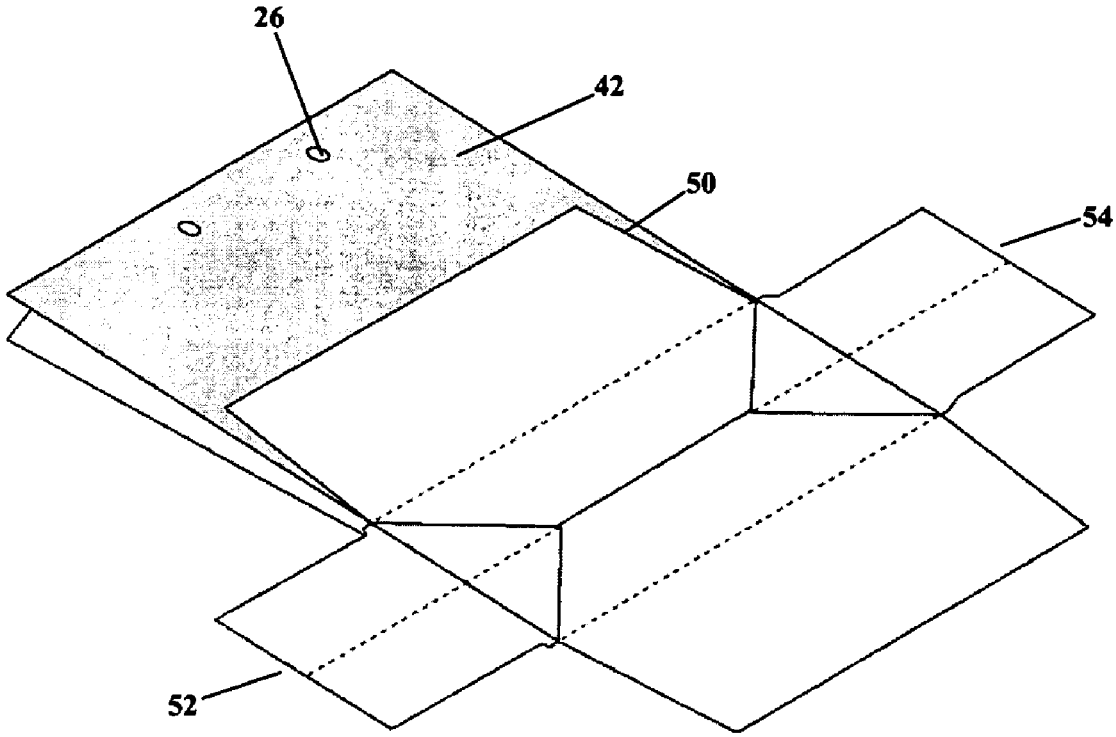
FIG. 5 is a top view of the bag at the midway point of the folding process.
Figure 6:
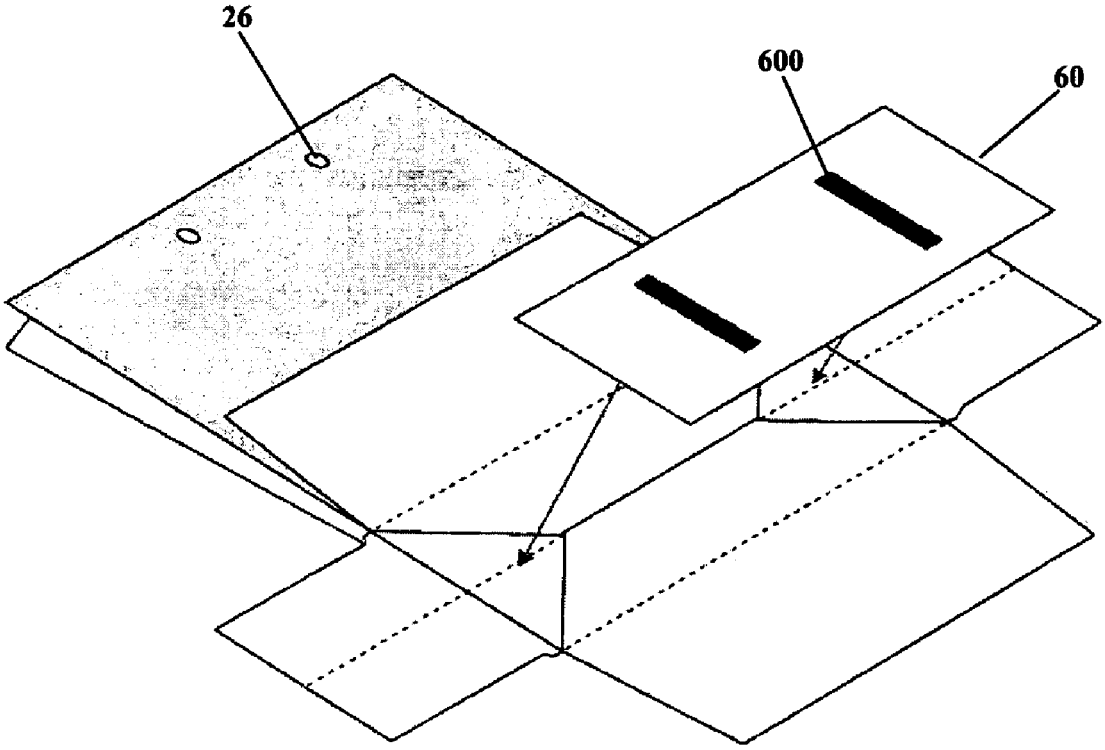
FIG. 6 is a top view of the bag during the reinforcing piece insertion step of the folding process.
Figure 7:
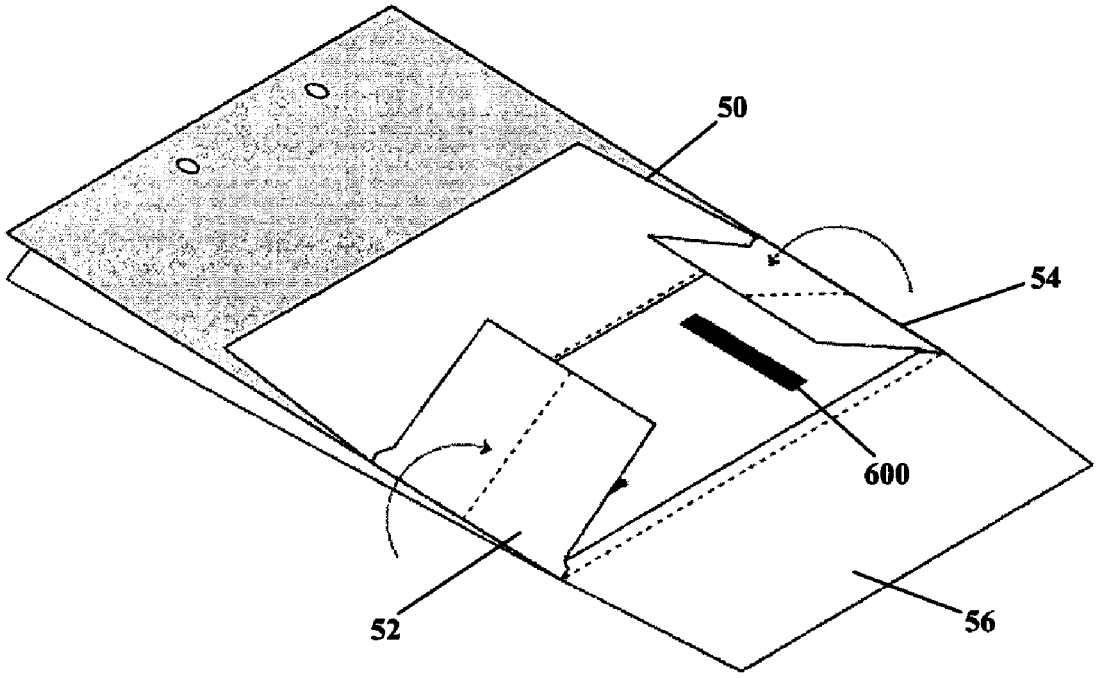
FIG. 7 is a top view of the bag during the side tab folding step.

As shown in FIG. 5, the bottom panels 50, 52 and 54 are unfolded in preparation for completing the bottom of the bag. If desired, a reinforcing panel 60 is inserted at this step, as shown in FIG. 6. The reinforcing panel includes glue spots 600 for securing panels 52 and 54, which are folded over in the direction of the arrows shown in FIG. 7.

Figure 8:
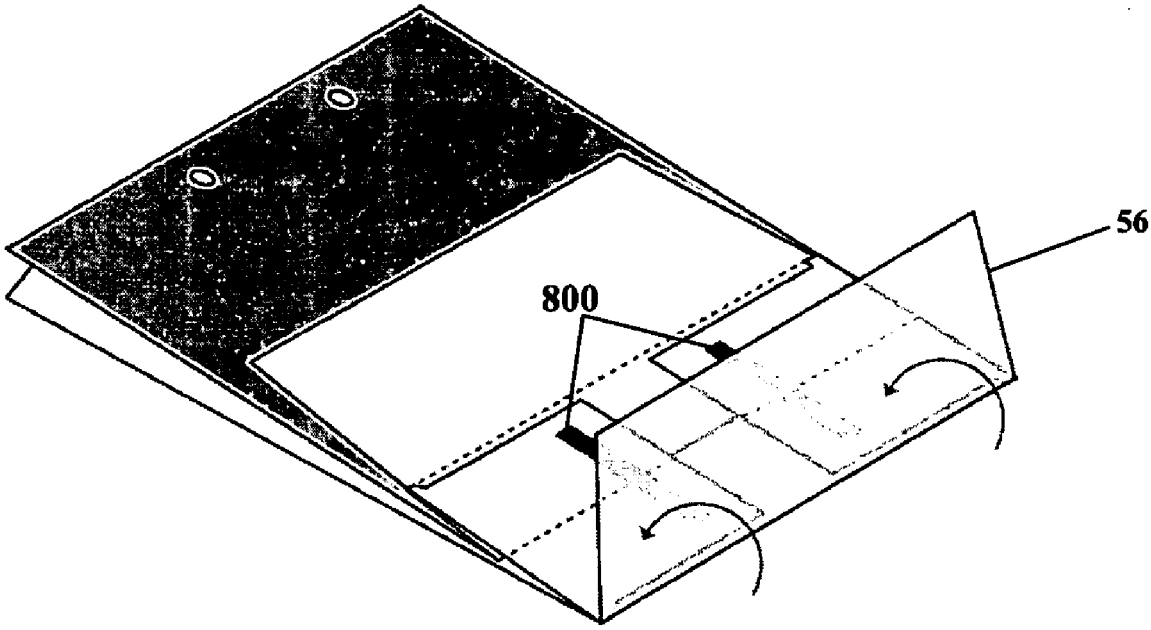
FIG. 8 is a top view of the bag during the first bottom folding step.
Figure 9:
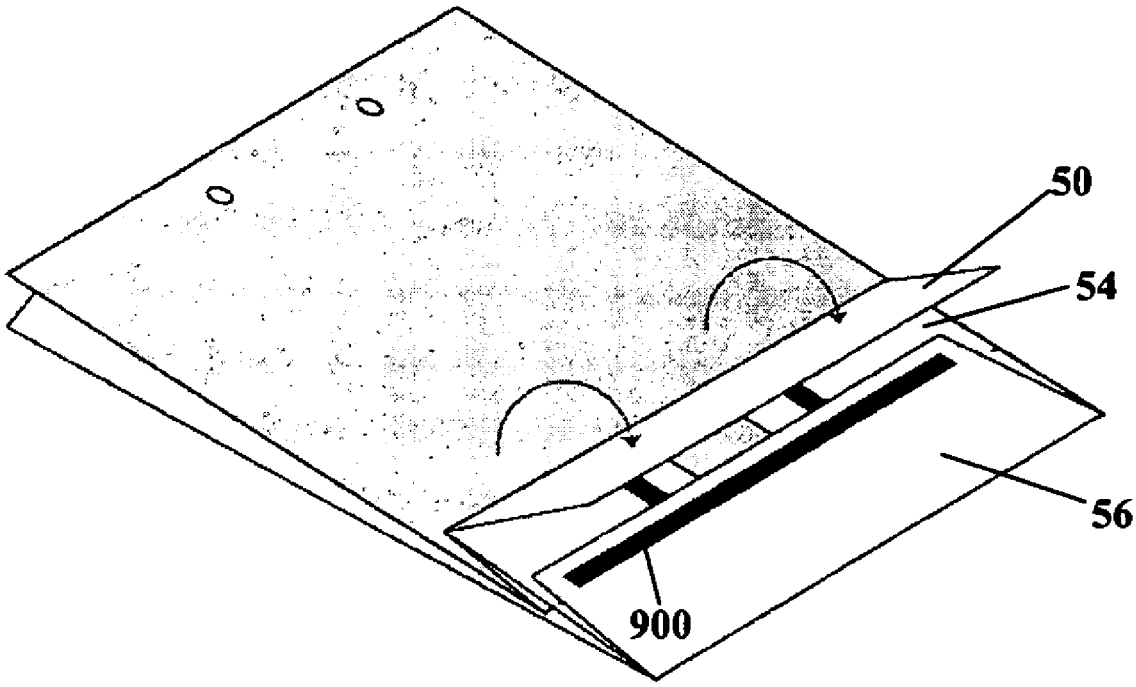
FIG. 9 is a top view of the bag during the final bottom folding step.

Bottom panel 56 is folded over and glued to panels 52 and 54 via glue spots 800, and then bottom panel 50 is folded over and glued to panels 52, 54 and 56 via glue spots 800 and 900, as shown in FIGS. 8 and 9, respectively.

The result is that the fully assembled and ready-to-use bag comes out of the machine, complete with glued seams and a reinforced bottom and top, and including a handle, if desired.

Also, while not explicitly shown in the drawings, any additional edges, surfaces or seams can be secured by using additional glue spots in suitable locations on the pattern as required.

The placing of the glue spots relative to the timing of the folds is not essential to the process. Depending on the type of glue used, it may be preferred to place all the glue spots prior to folding. Alternatively, glue spots may be applied as necessary during each step of the folding process.

As many of these types of containers, particularly the bags, have printed or applied images to the surfaces, it is further noted that the glue spots may be applied either before or after the printing/application process.

While traditionally the bags have been made from paper or cardboard, advances in modern materials technology have created the possibility of making containers from other lightweight, resilient and foldable materials, such as metallic films and thin plastics. The folding and gluing process claimed herein is considered generally applicable to any of these materials, although it is acknowledged that in some instances the process may be inferior to other methods or generally unsuitable. Each material and method may require testing to determine optimal size and location for the glue spots, and possible the type and strength of glue, as described above.

This concludes the description of a presently preferred embodiment of the invention. The foregoing description has been presented for the purpose of illustration and is not intended to be exhaustive or to limit the invention to the precise form disclosed. Many modifications and variations are possible in light of the above teaching and will be apparent to those skilled in the art. It is intended the scope of the invention be limited not by this description but by the claims that follow.

What is claimed is:

1. A machine-implemented method for automatically making a bag from a foldable pattern, the method comprising:

providing a foldable pattern having a foldable top margin, a foldable bottom margin, a pair first and second longitudinal side edges extending between the top and bottom margins, and a plurality of longitudinal body panels connected to each of the foldable top margin and the foldable bottom margin; the plurality of body panels disposed side-by-side between the first and second side edges and including first, second, third, fourth, fifth, sixth and seventh body panels; the first body panel being defined by the first side edge and a first longitudinal fold line; the second body panel being defined by the first fold line and a second longitudinal fold line; the third body panel being defined by the second fold line and a third longitudinal fold line; the fourth body panel being defined by the third fold line and a fourth longitudinal fold line; the fifth body panel being defined by the fourth fold line and a fifth longitudinal fold line; the sixth body panel being defined by the fifth fold line and a sixth fold longitudinal line; the seventh body panel being defined by the sixth fold line and the second side edge; the foldable bottom margin having a first portion connected to the second and third body panels, a second portion connected to the fourth body flap, a third portion connected to the fifth and sixth body flaps and a fourth portion connected to the seventh body flap;

folding the foldable top margin toward the plurality of body panels and securing the foldable top margin against the body panels;

folding the first body panel inwardly along the first fold line, the second body panel outwardly along the second fold line and the third body panel inwardly along the third fold line;

folding the seventh body panel inwardly along the sixth fold line, the sixth body panel outwardly along the fifth fold line and the fifth body panel inwardly along the fourth fold line;

securing the seventh body flap to the first body flap;

folding the first, second, third and fourth portions of the foldable bottom margin outwardly away from each other;

folding the first and third portions of the foldable bottom margins toward each other;

folding the second portion of the foldable bottom margin against the first and third portions and securing the second portion to the first and third portions;

folding the fourth portion of the foldable bottom margin against the second portion and securing the fourth portion to the second portion.

2. The method of claim 1 wherein:

the top foldable margin includes a top flap extending between the first and second longitudinal side edges and connected to the body flaps along a first top transverse fold line, and a pair of first and second tabs attached to the top flap along a second top transverse fold line; the first tab being disposed opposite the fourth body flap and the second tab being disposed opposite the seventh body flap; and the step of folding the foldable top margin includes folding the first and second tabs inwardly along the second top transverse fold line and securing the first and second tabs against the top flap.

3. The method of claim of claim 2 wherein:

the method further includes applying glue to locations along the top flap opposite the first and second tabs and adjacent the second top transverse fold line; and the step of securing the first and second tabs against the top flap includes causing the first and second tabs to adhere to the top flap at the locations where the glue has been applied thereon.

4. The method of claim 2 wherein the step of folding the foldable top margin further includes folding the top flap inwardly along the first top transverse fold line and securing the top flap against the body flaps.

5. The method of claim 4 wherein:

the method further includes applying glue to locations along the fourth and seventh body flaps adjacent the first top transverse fold line; and the step of securing the top flap against the body flaps includes causing the top flap to adhere to the fourth and seventh body flaps at the locations where the glue has been applied thereon.

6. The method of claim 1 wherein:

the method further includes applying glue to locations along the outer surface of the first body flap; and the step of securing the seventh body flap to the first body flap includes causing the seventh body flap to adhere to the first body flap at the locations where the glue has been applied thereon.

7. The method of claim 1 wherein:

the method further includes applying glue to locations along the outer surfaces of the first and third portions; and the step of securing the second portion to the first and third portions includes causing the second portion to adhere to the first and third portions at the locations where the glue has been applied thereon.

8. The method of claim 1 wherein:

the method further includes applying glue to locations along the outer surface of the second portion; and the step of securing the first and second tabs against the top flap includes causing the fourth portion to adhere to the second portion at the locations where the glue has been applied thereon.

9. The method of claim 1 wherein:

the foldable pattern includes top and bottom transverse edges;

each of the first, second, third and fourth portions of the foldable bottom margin extends between a bottom transverse fold line and the bottom transverse edge; and when the first, second, third and fourth portions of the foldable bottom margin are outwardly folded away from each other, the bottom transverse fold line defines a rectangular station.

10. The method of claim 9 further comprising, following the step of folding the first, second, third and fourth portions of the foldable bottom margin outwardly away from each other, the step of placing a reinforcing element within the station.

11. The method of claim 10 further comprising, following the step of folding the first and third portions of the foldable bottom margins toward each other, the step of securing the first and third portions of the foldable bottom margins to the reinforcing element.

12. The method of claim 11 wherein:

the method further includes applying glue to locations along the outer surface of the reinforcing element; and the step of securing the first and third portions of the foldable bottom margins to the reinforcing element includes causing the first and third portions of the foldable bottom margins to adhere to the outer surface of the reinforcing element at the locations where the glue has been applied thereon.

13. A machine-implemented method for automatically making a bag from a foldable pattern, the method comprising:

providing a foldable pattern having a foldable top margin, a foldable bottom margin, a pair first and second longitudinal side edges extending between the top and bottom margins, and a plurality of longitudinal body panels connected to each of the foldable top margin and the foldable bottom margin; the plurality of body panels disposed side-by-side between the first and second side edges and including first, second, third, fourth, fifth, sixth and seventh body panels; the first body panel being defined by the first side edge and a first longitudinal fold line; the second body panel being defined by the first fold line and a second longitudinal fold line; the third body panel being defined by the second fold line and a third longitudinal fold line; the fourth body panel being defined by the third fold line and a fourth longitudinal fold line; the fifth body panel being defined by the fourth fold line and a fifth longitudinal fold line; the sixth body panel being defined by the fifth fold line and a sixth fold longitudinal line; the seventh body panel being defined by the sixth fold line and the second side edge; the foldable bottom margin having a first, second, third and fourth portions connected to the body panels;

folding the foldable top margin toward the plurality of body panels and securing the foldable top margin against the body panels;

folding the body panels to create an open-ended collapsed bag body having a portion of the first body panel overlapping a portion of the seventh body panel;

securing the overlapping portion of the first body panel to the overlapping portion of the seventh body flap;

folding the first, second, third and fourth portions of the foldable bottom margin outwardly away from each other;

folding the first and third portions of the foldable bottom margins toward each other;

folding the second portion of the foldable bottom margin against the first and third portions and securing the second portion to the first and third portions;

folding the fourth portion of the foldable bottom margin against the second portion and securing the fourth portion to the second portion.

* * * * *